US007886996B2

(12) United States Patent
Horigane et al.

(10) Patent No.: US 7,886,996 B2
(45) Date of Patent: Feb. 15, 2011

(54) APPARATUS AND PROCESS FOR PRODUCING CRUSHED PRODUCT, CRUSHED PRODUCT AND PROCESSED GOOD

(75) Inventors: Akira Horigane, Ushiku (JP); Masaaki Horiguchi, Ushiku (JP)

(73) Assignee: Tsukuba Food Science, Inc., Ushiku-shi, Ibaraki (JP)

( * ) Notice: Subject to any disclaimer, the term of this patent is extended or adjusted under 35 U.S.C. 154(b) by 192 days.

(21) Appl. No.: 12/226,513

(22) PCT Filed: Apr. 27, 2006

(86) PCT No.: PCT/JP2006/308902

§ 371 (c)(1),
(2), (4) Date: Oct. 20, 2008

(87) PCT Pub. No.: WO2007/125588

PCT Pub. Date: Nov. 8, 2007

(65) Prior Publication Data

US 2009/0140084 A1 Jun. 4, 2009

(51) Int. Cl.
*B02C 7/12* (2006.01)

(52) U.S. Cl. ..... 241/22; 241/23; 241/65; 241/100; 241/259.1; 241/261.3

(58) Field of Classification Search ..... 241/65, 241/66, 67, 261.2, 261.3, 100, 259.1, 259.2, 241/259.3, 23, 22
See application file for complete search history.

(56) References Cited

U.S. PATENT DOCUMENTS 2,507,507 A * 5/1950 Egedal ..... 99/528
2,937,815 A * 5/1960 Eirich et al. ..... 241/257.1
3,089,655 A * 5/1963 Heinz et al. ..... 241/261.1
4,034,921 A 7/1977 Schnitzer
4,676,440 A * 6/1987 Perkola ..... 241/261.3
5,564,636 A * 10/1996 Mock et al. ..... 241/261.2
6,098,410 A 8/2000 Horigane
7,384,010 B2 * 6/2008 Horigane et al. ..... 241/23

FOREIGN PATENT DOCUMENTS

| | | |
|---|---|---|
| JP | 42-11191 | 6/1942 |
| JP | 51-39268 | 4/1976 |
| JP | 58-193742 | 11/1983 |
| JP | 11-151080 | 6/1999 |
| JP | 2000-197829 | 7/2000 |
| JP | 2005-087816 | 4/2005 |

* cited by examiner

*Primary Examiner*—Mark Rosenbaum
(74) *Attorney, Agent, or Firm*—Flynn, Thiel, Boutell & Tanis, P.C.

(57) ABSTRACT

A raw material is fed through a raw material supply channel into a raw material introduction part between a fixed grinding disc and a moving grinding disc. The moving grinding disc is provided on a drive shaft and the gap between the same and the fixed grinding disc is adjusted by means of a gap adjusting mechanism. Heat transfer from the drive unit is prevented while power is transmitted to the drive shaft to rotate the moving grinding disc. The raw material while being transferred through the coarse grinding distributing channel is coarsely ground and any raw material of low grindability is crushed by the crushing part, distributed to the microgrinding part and microground to thereby attain the production of ground matter.

10 Claims, 5 Drawing Sheets

APPARATUS AND PROCESS FOR PRODUCING CRUSHED PRODUCT, CRUSHED PRODUCT AND PROCESSED GOOD

TECHNICAL FIELD

The present invention relates to an apparatus and a process for producing crushed products by crushing a material, such as a food raw material or other, in particular, a granular crushable material, for example, wheat, rice, buckwheat or soybean, as well as to the crushed product obtained and to processed goods. More specifically, the present invention relates to an apparatus and a process for producing a crushed product of a uniform particle size by abrading a grain surface layer and crushing a granular material, by means of a pair of opposingly disposed crushing discs; to the crushed product obtained; and to processed goods.

TECHNOLOGICAL BACKGROUND

For producing a crushed product by crushing a food raw material, such as a biological material, organic material, chemical substance or so on, there have practically been used a technique in which a pair of opposingly disposed crushing discs, such as a stone mill, is used for crushing the food raw material. In this technique, the raw material to be crushed, such as a food raw material, is supplied between a pair of opposingly disposed crushing discs, wherein the raw material is crushed in between the two crushing discs by rotating at least one of the crushing discs to produce a crushed product.

On the crusher face of the stone mill are formed grooves running radially from a central portion thereof. The raw material to be crushed is supplied to the mill gap between the two crushing discs via a feed entrance port disposed in the central portion at a location biased from the center, in which the raw material is at first only roughly crushed in the central region of the mill gap and is expelled aside succeedingly to the outer region where it is subjected to fine crushing. Conventional crushing techniques using a stone mill or the like suffers, however, from an inconvenience, that a cereal raw material having a thin flexible skin layer, such as wheat, buckwheat or soybean, can be crushed only insufficiently, in which the substance of albumen can be crushed finely, but the substance around the flexible skin layer cannot be crushed finely and the roughly crushed grains of larger particle sizes will pass through the mill gap and are collected at the disc periphery.

In such a crushing technique, therefore, it is not able to obtain a fine powdery crushed product of a uniform particle size as a whole. In an attempt to increase the productivity by a size reduction of the apparatus in such conventional techniques, it may be considered to use steel crushing discs to realize a high speed rotation, however, it is difficult to effect fine crushing of the material around the thin flexible skin layer. Also, in other measures using a roller mill and other types of crushers, there may be encountered a similar inconvenience.

When an apparatus of the crushing disc rotation type is operated at a high speed rotation, the resulting crushed product is apt to suffer from a debasement in quality, such as taste, mouth feel and the like, due to superfluous heat and oxidation, causing a denaturation of the component substances in the raw material. Apparatuses of the crushing disc rotation type may, in general, be constructed with a mechanism in which one of the crushing discs is rotated by a driving means and the driving mechanism is complicated due to a biased driving, so that there is some difficulty in cooling the driving side elements. Thus, cooling of the driving side crushing disc may be achieved only difficultly, though the stationary side crushing disc may be cooled easily. Therefore, it is difficult to prevent quality debasement of the resulting crushed product in such an apparatus.

As a countermeasure for improving such a problem, there has been proposed in Patent Document 1 (JPA 2005-87816), a process and an apparatus for producing a crushed product by establishing a crushing section between confronting crusher faces of a pair of crushing discs, in which a rotatable crushing disc is rotated by means of a driving device wherein a stationary crushing disc is cooled by a cooling part and the raw material is supplied to the crushing section to effect the crushing thereof while supplying a cooled inert gas to the crushing section to replace atmospheric oxygen gas included in the raw material by the inert gas and, at the same time, to cool the raw material, whereupon the resulting crushed product is guided out from the crushing section into a crushed product receiver. Here, it is proposed that the spent inert gas which has been used for cooling the raw material is guided to the rear face of the rotatable crushing disc to cool the rotatable crushing disc. However, it suffers from a problem that the cooling of the rotatable crushing disc may be difficult to attain, since the rotatable crushing disc is subjected to heating due to heat transfer from the driving device connected thereto.

In Patent Document 2 (JPA 11-151080), there is disclosed a method of freeze-drying, in which the material to be treated is mixed with dry ice and is crushed to thereby cause the material to be frozen to subject it to freeze-drying, while replacing the gas phase with the thereby generated carbon dioxide gas. However, it is not disclosed therein that a raw material is crushed by means of a pair of crushing discs to produce crushed product while preventing debasement of the product quality.

OBJECT OF THE INVENTION

The object of the present invention is to provide an apparatus and a process capable of producing a crushed product of superior quality without suffering from denaturation and to provide a crushed product and processed goods, in which it is possible to crush efficiently and effect fine crushing into micro-powder even a raw material having a flexible skin layer, such as cereal grains, by a simple apparatus and in a simple operation, whereby a crushed product of a fine powder of a uniform particle size can be obtained while preventing excessive heating.

BRIEF DESCRIPTION OF THE INVENTION

The present invention is directed to an apparatus and a process for producing a crushed product, the crushed product obtained and in processed goods, as given below:

(1) An apparatus for producing a crushed product comprising a stationary crushing disc provided in its central portion with a raw material entrance port and in the outer region on its underside with a crush face, a rotatable crushing disc disposed beneath the stationary crushing disc in opposition thereto so as to build up a mill gap therebetween and provided, on its upper side, in the inner region with an abrader face, in the outer circumferential region with a fine-crush face and in the inner region with a plurality of rough-crush dispensing grooves extending from the central portion to the fine-crush face in a bent form towards the rotation tail, a driving shaft is fixedly connected to the central portion of the rotatable crushing disc and extends through the stationary crushing disc up above the stationary crushing disc, a power transmission means transmitting a rotational power from a driving device to the driving shaft under the prevention of heat transfer, a mill gap adjusting means which suspends the rotational crushing disc through the driving shaft and is operable to adjust the mill gap between the stationary and the rotatable crushing discs, a cooling means for cooling the stationary crushing disc and/or the rotatable crushing disc, a raw material supply path for supplying the raw material to the raw material entrance port in the stationary crushing disc and a crushed product receiver for receiving the crushed product expelled out of the mill gap at the disc periphery.

(2) The apparatus as defined in the above (1), wherein the stationary crushing disc is provided, in the inner region on the underside thereof, with an abrader face and/or a plurality of rough-crush dispensing grooves.

(3) The apparatus as defined in the above (1) or (2), wherein the stationary crushing disc is provided on the abrader face with a layer of an abrader material.

(4) The apparatus as defined in any one of the above (1) to (3), wherein the rotatable crushing disc is provided on its fine-crush face with a plurality of thin grooves extending from the central portion to the outer circumferential region in a bent form towards the rotation tail.

(5) The apparatus as defined in any one of the above (1) to (4), wherein the rough-crush dispensing groove is provided on the side towards the rotation head thereof with a dispensing section which becomes shallower towards the outside periphery of the groove.

(6) The apparatus as defined in any one of the above (1) to (5), wherein a plurality of raw material supply paths are arranged for supplying a plurality of raw materials to the raw material entrance port.

(7) A process for producing a crushed product, comprising supplying a raw material to be crushed via one or more raw material supply paths to a mill gap between a stationary crushing disc provided in its central portion with a raw material entrance port and in the outer region on its underside with a crush face, on the one hand, and a rotatable crushing disc disposed beneath the stationary crushing disc in opposition thereto and provided on its upper side, in the inner region, with an abrader face, in the outer circumferential region, with a fine-crush face and, in the inner region, with a plurality of rough-crush dispensing grooves extending from the central portion to the fine-crush face in a bent form towards the rotation tail, on the other hand, adjusting the mill gap between the stationary crushing disc and the rotatable crushing disc by means of a mill gap adjusting means which suspends the rotatable crushing disc through a driving shaft, rotating the rotatable crushing disc by transmitting a rotational power from a driving device to the driving shaft while preventing heat transfer and cooling the stationary crushing disc and/or the rotatable crushing disc, effecting a rough crushing of the raw material while the raw material is caused to travel through the rough-crush dispensing groove from the raw material entrance port and, at the same time, breaking down a hardly crushable raw material between the underside of the stationary disc and the abrader face of the rotatable crushing disc and dispensing the resulting roughly crushed mass to the mill gap between the crush faces from the rough-crush dispensing grooves to subject it to fine crushing and collecting the resulting crushed product expelled out of the mill gap between the stationary and the rotatable crushing discs at the disc periphery.

(8) The process as defined in the above (7), wherein a plurality of raw materials are supplied from a plurality of raw material supply paths to the raw material entrance port to effect co-crushing.

(9) The process as defined in the above (8), wherein one of the raw materials is a coolant so that the co-crushing is effected under cooling.

(10) The process as defined in any one of the above (7) to (9), wherein the crushed product is produced using an apparatus as defined in any one of the above (1) to (6).

(11) A crushed product obtained by the process as defined in any one of the above (7) to (10).

(12) Processed goods which comprise the crushed product as defined in the above (11).

In the present invention, as the raw material to be crushed, there may be recited any material subject to crushing without any restriction, for example, food raw material, such as wheat, rice, buckwheat and soybean, as well as other raw materials including a biological material, organic material, chemical substance and so on. Among them, there may be recited as an adapted raw material, cereal grains having a thin flexible skin layer, such as wheat, buckwheat and soybean, and other granular material exhibiting a difficultly crushable thin skin layer, though it is not restricted thereto.

The apparatus to be used for the process for producing a crushed product according to the present invention comprises a stationary crushing disc provided in its central portion with a raw material entrance port and in the outer region on its underside with a crush face, a rotatable crushing disc disposed beneath the stationary crushing disc in opposition thereto so as to build up a mill gap therebetween and provided, on its upper side, in the inner region with an abrader face, in the outer circumferential region with a fine-crush face and in the inner region with a plurality of rough-crush dispensing grooves extending from the central portion to the fine-crush face in a bent form towards the rotation tail, a driving shaft which is fixedly connected to the central portion of the rotatable crushing disc and extends through the stationary crushing disc up above the stationary crushing disc, a power transmission means transmitting a rotational power from a driving means to the driving shaft while preventing heat transfer, a mill gap adjusting means which suspends the rotatable crushing disc through the driving shaft and is operable to adjust the mill gap between the stationary and the rotatable crushing discs, a cooling means for cooling the stationary crushing disc and/or the rotatable crushing disc, a raw material supply path for supplying the raw material to the raw material entrance port in the stationary crushing disc and a crushed product receiver for receiving the crushed product expelled out of the mill gap between the stationary crushing disc and the rotatable crushing disc at the disc periphery.

The stationary and the rotatable crushing discs are made from a steel or other metal each in a shape of disc. It is preferable to form them each in the shape of a circular disc, though other shapes may be permitted. The stationary crushing disc is provided in the central portion with a raw material entrance port and in the outer region on its underside with a crush face. The rotatable crushing disc is provided, on its upper side, in the inner region with an abrader face, in the outer circumferential region with a fine-crush face and in the inner region with a plurality of rough-crush dispensing grooves extending from the central portion to the fine-crush face in a bent form towards the rotation tail. Thus, a crushing section is built between the confronting faces of the underside face of the stationary crushing disc, on the one hand, and the upper side face of the rotatable crushing disc, on the other hand, when the stationary crushing disc and the rotatable crushing disc are arranged opposingly in position. The crushing section is composed of a breaking-down part formed between the abrader faces of the stationary crushing disc and of the rotatable crushing disc, on the one hand, and a fine-crushing part formed between the fine-crush faces of the stationary crushing disc and of the rotatable crushing disc, on the other hand. The rough crush dispensing grooves each constitute a rough crushing site in which the raw material is subjected to rough crushing in the course of traveling therein. It is permissible that the stationary crushing disc is provided over its entire underside face with such a crush face or that an abrader face and/or a plurality of rough-crush dispensing grooves are arranged in the inner region and a fine-crush face is arranged in the outer circumferential region, as in the rotatable crushing disc.

The crushing section built up upon assemblage of the stationary and the rotatable crushing discs in opposition to each other is constituted of a breaking-down part formed between the abrader faces of the stationary crushing disc and the rotatable crushing disc, on the one hand, and a fine-crushing part formed between the fine-crush faces of the stationary crushing disc and the rotatable crushing disc, on the other hand. The rough-crush dispensing grooves form a rough-crushing site in which the raw material is subjected to rough crushing while it is traveling therethrough. The distance between the crush face of the stationary crushing disc and the fine-crush face of the rotatable crushing disc in the fine-crushing part of outer circumferential region is decided in accordance with the contemplated particle size of the resulting crushed product and may, in general, be in the range of 5-2,000 μm, preferably 10-200 μm. In the breaking-down part on the side of the central portion, the distance between the crush face of the stationary crushing disc and the abrader face of the rotatable crushing disc is determined by the grain size of the raw material to be crushed and may, in general, be in the range of 0.5-20 mm, preferably 1-10 mm.

The abrader faces constituting the breaking-down part of the crushing section are built up with a role of abrading the surface of the raw material grain so as to break or to crack the difficultly crushable thin flexible skin layer formed on the grain surface to break it down and so as to effect a rough crushing of the whole or a part of the raw material grain. While the abrader face may be formed bodily with the crushing disc if the material of the disc allows, it may be preferable to form the abrader face from a material having a hardness higher than that of the crushing disc. For forming such an abrader face, there may be recited a layer of whet grains, for example, granular diamond, granular CBN (cubic boron nitride) and granular WA (white aluminum oxide). For the whet grain layer, there may preferably be recited those which are made of a fixed layer fixed on the abrader face, in which the whet grains made of granular diamond, granular CBN, granular WA and the like are attached to the abrader face by means of a fixation measure, such as a metal plating with a metal of nickel or the like. The grain size of the whet grains of granular diamond, granular CBN, granular WA and the like may be in the range of 0.005-0.6 mm, preferably 0.05-0.5 mm. The thickness of the plated fixed layer may be in the range of 0.005-0.3 mm, preferably 0.025-0.25 mm. It is preferable that the whet grain layer is constructed in such a manner in which the whet grains are distributed in a random distribution, each protruding out on the layer surface similarly to that of sand paper. The surface level of the abrader face may be at the same level with that of the fine-crush face, while it is preferable that the surface level of the abrader face is somewhat recessed from the surface level of the fine-crush face. The recessed depth of the surface of the abrader face is determined by the grain size of the material to be crushed, while it may, in general, be 0.5-10 mm, preferable 1-8 mm.

The fine-crush face disposed in the outer circumferential region on both crushing discs may preferably be provided with a plurality of thin grooves extending radially from the center side (abrader face side) to a peripheral side in the form of a circular arc. The thin grooves of circular arcuate form may preferably extend in the form of a circular arc corresponding nearly to the flow line of the crushed fine powder observed on the crushing disc in accordance with the rotation of the crushing disc (namely, in some eddying form established when particles are strewed radially from the center on the rotating disc). Here, the expression "form of a circular arc" means a configuration similar to an arc, such as a circular arc, elliptical arc or spiral arc. The circular arcuate thin grooves formed on the crush faces may have a width of 10-500 μm, preferably 50-500 μm, and a depth of 50-1,000 μm, preferably 100-500 μm, and may be formed by, for example, machine grinding, laser machining or water-jet machining. It is preferable that the thin circular arculate grooves on the crush face of at least one crushing disc are formed by machine grinding or laser machining.

The rough-crush dispensing grooves formed on both crushing discs extend from the central portion to the fine-crush face in a bent form eddywise towards the rotation tail to constitute a rough-crushing site for roughly crushing the raw material during its travel therein and for dispensing the resulting roughly crushed mass therefrom to the fine-crushing part. The rough-crush dispensing grooves may preferably be formed such that each of them extends in a circularly arcuate form of a nearly concentric circle with the circumferential circle of the crushing disc and communicates to the fine-crushing part so as to effectively dispense the roughly crushed mass uniformly to the fine-crushing part. When each of the rough-crush dispensing grooves are not permitted to be formed in a circular form nearly concentric with the circumferential circle of the crushing disc, it may be preferable to provide each groove with a dispensing section on the side of the rotation head which section becomes shallower towards the outside periphery of the groove so as to cause it to communicate with the fine-crushing part via an arcuate form site of nearly a circle concentric with the circumferential circle of the crushing disc. It is preferable that the rough-crush dispensing groove is deeper than the abrader face and the depth of the dispensing section is in the middle between them. These depths are determined in accordance with the grain size of the material to be crushed and, in general, the depth of the rough-crush dispensing groove may be in the range of 0.5-20 mm, preferably 1-10 mm, and the depth of the dispensing section may be in the range of 0.5-20 mm, preferably 1-10 mm.

The crush face on the underside of the stationary crushing disc may cover the entire area of the underside, while it is permitted that an abrader face and/or a plurality of rough-crush dispensing grooves are arranged in the inner region and a fine-crush face is arranged in the outer circumferential region, as in the rotatable crushing disc. When the underside of the stationary crushing disc is formed in the same structure as the upper side of the rotatable crushing disc, the abrader face, rough-crush dispensing grooves and the fine-crush face may be formed in the same manner as above. When the crush face is formed over the entire area of the underside, the crush face may be formed in the same manner as the fine-crush face mentioned above, though more roughly distributed fine-crush grooves may be permitted occasionally. The depth of the grooves to be formed on the crush face is determined by the grain size of the supplied raw material and, in general, may be in the range of 0.5-10 mm, preferably 1-8 mm.

The stationary and the rotatable crushing discs may each be formed in a shape nearly the same with each other with a structure different from each other as described above and the two are coupled one over another to build up a crushing mill. Here, the thin circular arcuate grooves formed on the fine-crush faces on both of the discs are put in opposition to each other each in a direction crossing to other. The pair of crushing discs should preferably be settled in a horizontal posture, though an inclined posture may be permitted. The stationary crushing disc is fixedly held on a support element or the like on the crusher body. A driving shaft is arranged in the central portion of the rotatable crushing disc by being fixed thereto in an immovable relationship therewith and is constructed such that it extends through the stationary crushing disc at its raw material entrance port up above the stationary disc and is connected with a mill gap adjusting means, while it suspends the rotatable crushing disc. The driving shaft is connected with a driving device through a heat insulating power transmission means, such as a belt or the like, for transmitting rotational driving power under the prevention of heat transfer.

While it is preferable that the stationary and/or rotatable crushing disc may be constructed so as to be cooled by a cooling means, such as a cooling element, it is permissible that the cooling is effected by a measure such as heat radiation or ventilation. The raw material supply path communicates to the raw material entrance port in the central portion of the stationary crushing disc to allow supply of the raw material from the raw material entrance port to the crushing section via the rough-crush dispensing grooves, while it is permissible to construct the apparatus in such a structure that breaking down or rough crushing of the raw material is performed within the raw material entrance port. A plurality of raw material supply paths may be installed for supplying a plurality of raw materials to the raw material entrance port. Here, one of the raw materials may be a coolant so that the crushing is carried out under cooling. The crushed product receiver is arranged for collecting the crushed product expelled out of the mill gap between the stationary and the rotatable crushing discs at the disc periphery and may have a configuration of, for example, a vessel, hopper or so on, in which the crushed product may be collected by free falling, by air-blow exhaustion or by other collecting means.

The process for producing a crushed product according to the present invention is realized using the apparatus as described above for crushing the raw material supplied. The process comprises the process steps of supplying a raw material to be crushed via one or more raw material supply paths to a mill gap between a stationary crushing disc provided in its central portion with a raw material entrance port and in the outer region on its underside with a crush face, on the one hand, and a rotatable crushing disc disposed beneath the stationary crushing disc in opposition thereto and provided, on its upper side, in the inner region, with an abrader face, in the outer circumferential region, with a fine-crush face and, in the inner region, with a plurality of rough-crush dispensing grooves extending from the central portion to the fine-crush face in a form bent towards the rotation tail, on the other hand; adjusting the mill gap between the stationary crushing disc and the rotatable crushing disc by means of a mill gap adjusting means which suspends the rotatable crushing disc through a driving shaft; rotating the rotatable crushing disc by transmitting a rotational power from a driving device to the driving shaft under the prevention of heat transfer while cooling the stationary crushing disc and/or the rotatable crushing disc; effecting a rough crushing of the raw material while the raw material is caused to travel through the rough-crush dispensing groove from the raw material entrance port and, at the same time, breaking down a hardly crushable raw material between the underside of the stationary disc and the abrader face of the rotatable crushing disc and dispensing the resulting roughly crushed mass to the mill gap between the crush faces from the rough-crush dispensing grooves to subject it to fine crushing; and collecting the resulting crushed product expelled out of the mill gap between the stationary and the rotatable crushing discs at the disc periphery.

In the crushing section, the raw material is subjected to a rough crushing in the course in which the raw material travels through the rough-crush dispensing groove by rotating the rotatable crushing disc and the surface of the raw material grain is subjected to abrasion by the abrader face to break or crack the difficultly crushable thin film formed on the grain surface, such as a flexible thin surface skin, to break it down, while, at the same time, effecting partial rough crushing of a part of the raw material or the broken grains. When abrader face formed with a layer of abrader material of whet grains, such as granular diamond, granular CBN or granular alumina, is used, breaking down of the skin layer of the raw material grain may be realized more easily, since the irregularly distributed whet grains protruding out from the abrader face will easily pierce into the skin layer to cause it to break.

The roughly crushed raw material is dispensed from the rough-crush dispensing groove to the fine-crushing part. Since the rough-crush dispensing grooves are arranged extending from the central portion to the fine-crush face in a form bent eddying out towards the rotation tail, each of the rough-crush dispensing grooves assumes at its terminal end part a circular arcuate form nearly concentric with the circumferential circle of the crushing disc and the roughly crushed material will be dispensed from the circularly arcuate end portion to the fine-crushing part, whereby a uniform dispensing of the roughly crushed material to the fine-crushing part will be realized. When each of the rough-crush dispensing grooves are not permitted to be formed in a circular form nearly concentric with the circumferential circle of the crushing disc, it may be preferable to provide each groove with a dispensing section on the side of the rotation head, the section becoming shallow towards the outside periphery of the groove so as to cause it to communicate to the fine-crushing part via an arcuate form site of nearly a circle concentric with the circumferential circle of the crushing disc, whereby the roughly crushed material will be dispensed to the fine-crushing part uniformly.

The raw material which has been subjected to breaking down and to rough crushing in the abrading section and in the rough-crush dispensing grooves is then subjected in the fine-crushing part formed in the outer circumferential region of the crushing discs to shearing and breaking in between the fine-crush faces to effect crushing thereof, whereby a crushed product of fine particle size is obtained. During this, the difficultly crushable thin skin layer that has been subjected in the abrading section to breaking down and to destruction by cracking is also crushed into small size particles, whereby a crushed product of wholly uniform fine particle size is obtained. When the fine-crush face is provided with many thin grooves of circular arcuate form, with each extending radially from the center side (the abrader face side) towards the outer circumferential region, the shearing and crushing effects will be increased by these circular arcuate thin grooves, whereby the crushing efficiency becomes higher. In particular, the shearing and crushing effect is higher in the circular arcuate thin grooves formed by machine grinding and laser machining, since the machined edges are sharply finished.

The particle size of the crushed product can be adjusted by adjusting the mill gap between the stationary and the rotatable crushing discs using the mill gap adjusting means. The rotatable crushing disc is suspended by the driving shaft from the mill gap adjusting means and can be rotated by the driving shaft under prevention of heat transfer from the driving device by transmitting a rotational power thereto by means of a heat-insulating power transmission means, such as belt or the like. Heat generation is only limited to frictional heat due to rotation of the rotatable crushing disc. Therefore, the entire apparatus can be cooled by cooling the stationary crushing disc and/or the rotatable crushing disc through a cooling means, to thereby attain cooling of the raw material and the crushed product, whereby deterioration of the quality of the crushed product can be prevented. In conventional crushing apparatuses, the denaturation of component substances may occur due to superfluous heating or oxidation when the rotatable crushing disc is rotated at a high speed of, for example, 50-200 rpm, whereby crushed product of food may suffer from a debasement in quality, such as taste and mouth feel, in contrast to the crushed product of the present invention in which any denaturation or quality debasement is prevented due to the prevention of heat generation, as described above.

In operating a rotary crushing mill at a high rotation rate, there may occur occasionally the trouble of machine blockage due to impasting of the crushed product within the mill gap between the crushing discs. This trouble can be avoided in the apparatus of the present invention, since the rough-crush dispensing grooves are arranged extending from the central portion to the fine-crush face in a bent form eddying out towards the rotation tail so as to communicate with the fine-crushing part at its terminal end in a circular arcuate form nearly concentric with the circumferential circle of the crushing disc, whereby the roughly crushed material is dispensed from such a circularly arcuate end portion to the fine-crushing part uniformly to thereby attain prevention of impasting and blockage. When each of the rough-crush dispensing grooves are not permitted to be formed in a circular form nearly concentric with the circumferential circle of the crushing disc, it is preferable to provide each groove with a dispensing section on the side of the rotation head, the section becoming shallower towards the outside periphery of the groove so as to cause it to communicate with the fine-crushing part via a site of an arcuate form of nearly a circle concentric with the circumferential circle of the crushing disc, whereby the roughly crushed material will be dispensed to the fine-crushing part uniformly. If the distance of travel of the roughly crushed mass through the fine-crushing part is longer, impasting of the crushed product may be apt to occur. Such an impasting trouble may be avoided by designing the grooves to have the pertinent length with uniform distribution over the entire area of the fine-crushing part. By establishing communication with the fine-crushing part at the site of an arcuate form of nearly a circle concentric with the circumferential circle of the disc, the roughly crushed mass is dispensed to the fine-crushing part in the radial direction uniformly and will pass through the fine-crushing part over a shorter distance, whereby impasting trouble can be avoided.

The crushed product is expelled out of the mill gap between the stationary disc and the rotatable crushing disc at the disc periphery and is collected into a crushed product receiver. If the raw material supply path is installed in a plural number, a plurality of raw materials can be supplied via different raw material supply paths to effect co-crushing of them. When one raw material consists of a coolant, it is possible to perform the crushing while cooling the raw material by co-crushing with the coolant, whereby heat accumulation and denaturation and oxidation of the crushed product can be avoided.

The crushed product according to the present invention is obtained by the process described above, so that a crushed product wholly having a uniform particle size can be obtained even when the granular raw material has a difficultly crushable flexible thin skin film, such as a cereal crop. The processed goods according to the present invention contain the fine powdery crushed product obtained as above, so that processed goods of superior quality can be obtained due to the wholly uniform particle size of the powdery product used.

As described above, the present invention provides for a technical measure of supplying a raw material to be crushed via one or more raw material supply paths to a mill gap between a stationary crushing disc provided in its central portion with a raw material entrance port and in the outer region on its underside with a crush face, on the one hand, and a rotatable crushing disc disposed beneath the stationary crushing disc in opposition thereto and provided on its upper side, in the inner region, with an abrader face, in the outer circumferential region, with a fine-crush face and, in the inner region, with a plurality of rough-crush dispensing grooves extending from the central portion to the fine-crush face in a form bent towards the rotation tail, on the other hand; adjusting the mill gap between the stationary and the rotatable crushing discs by means of a mill gap adjusting means which suspends the rotatable crushing disc through the driving shaft; rotating the rotatable crushing disc by transmitting a rotational power from a driving device to the driving shaft while preventing heat transfer while cooling the stationary crushing disc and/or the rotatable crushing disc; effecting a rough crushing of the raw material while the raw material is caused to travel through the rough-crush dispensing groove from the raw material entrance port and, at the same time, breaking down a hardly crushable raw material between the underside of the stationary disc and the abrader face of the rotatable crushing disc and dispending the resulting roughly crushed mass to the mill gap between the crush faces from the rough-crush dispensing grooves to subject it to fine crushing; and collecting the resulting crushed product expelled out of the mill gap between the stationary and the rotatable crushing discs at the disc periphery. Thereby, it is now possible to provide, in the first place, an apparatus and a process for producing crushed product, by which it is able to attain a fine crushing of even a granular raw material having on each grain surface a flexible thin skin film, such as a cereal crop, in an efficient manner by a simple apparatus and simple operation, by breaking down the hardly crushable thin skin film, whereby a fine powdery crushed product of uniform particle size with less denaturation and superior quality can be obtained while performing the crushing of the raw material efficiently and preventing superfluous heating; in the second place, the crushed product obtained thereby; and in the third place, processed goods.

BRIEF EXPLANATION OF THE APPENDED DRAWINGS

Figure 1:
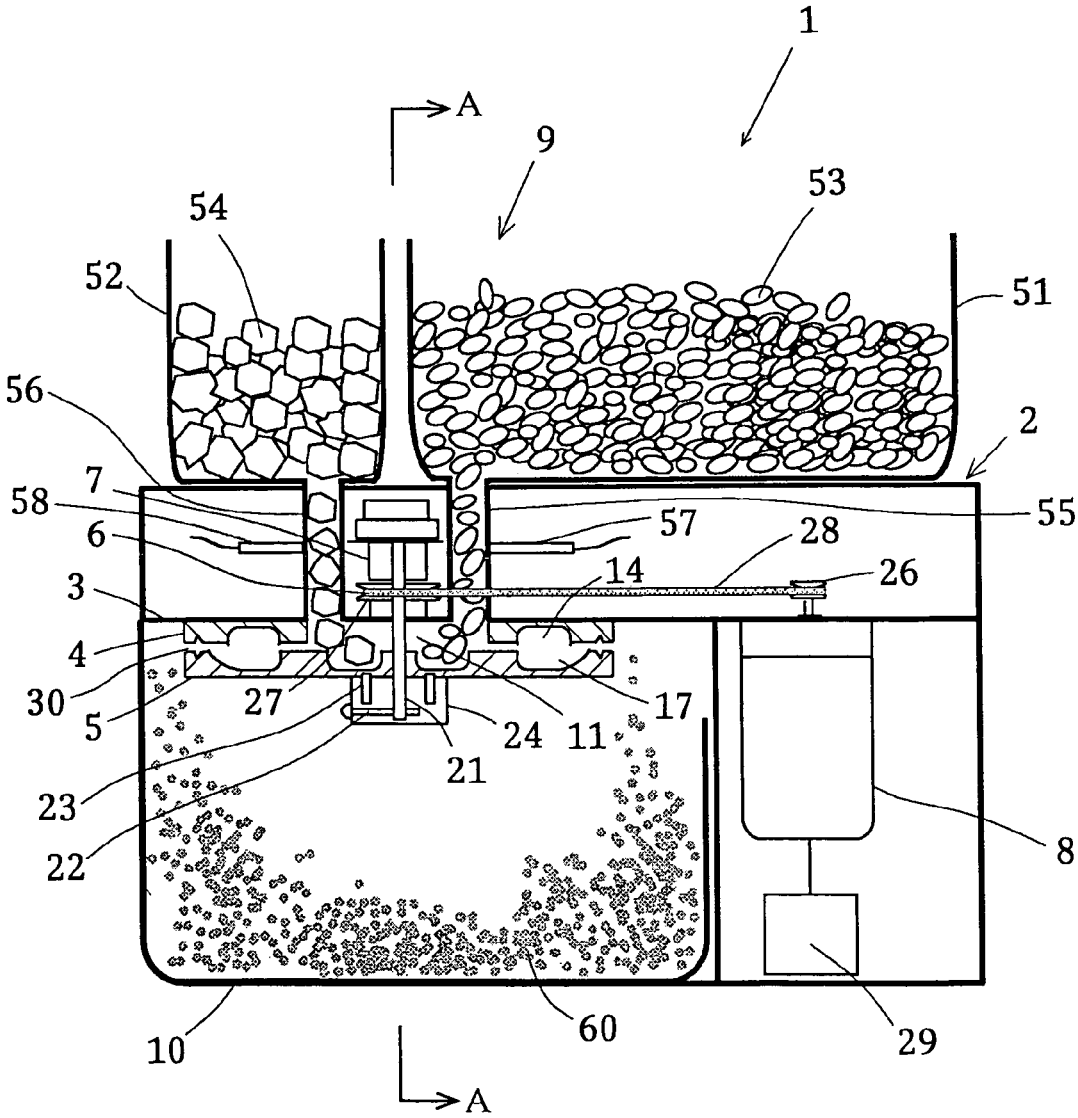
FIG. 1 is a vertical section of an embodiment of the apparatus according to the present invention as described in Example 1.
Figure 2:
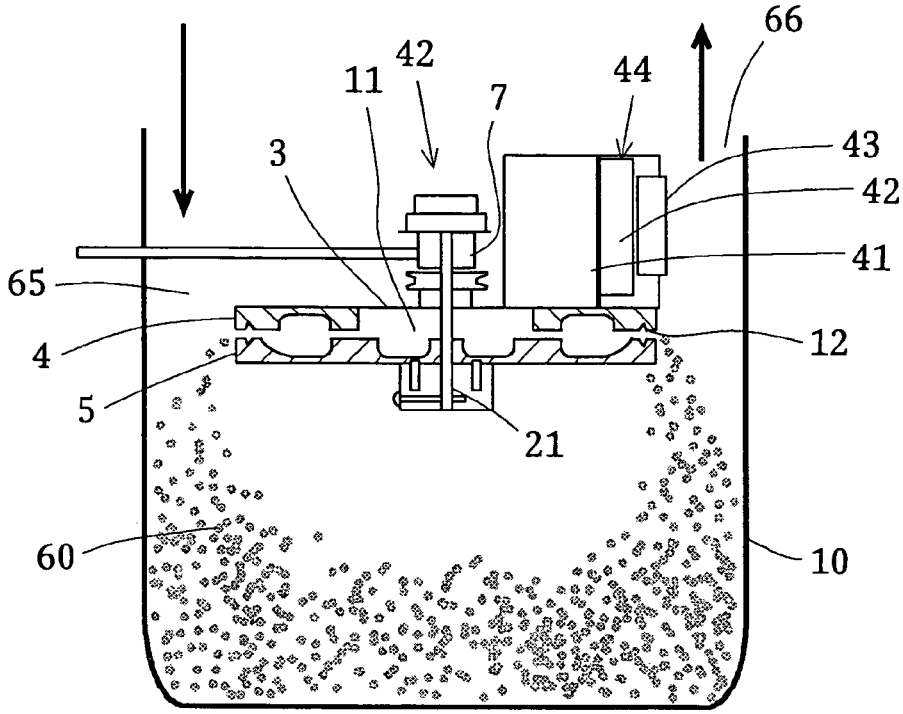
FIG. 2 is a partial sectional view along the line A-A in FIG. 1.
Figure 3:
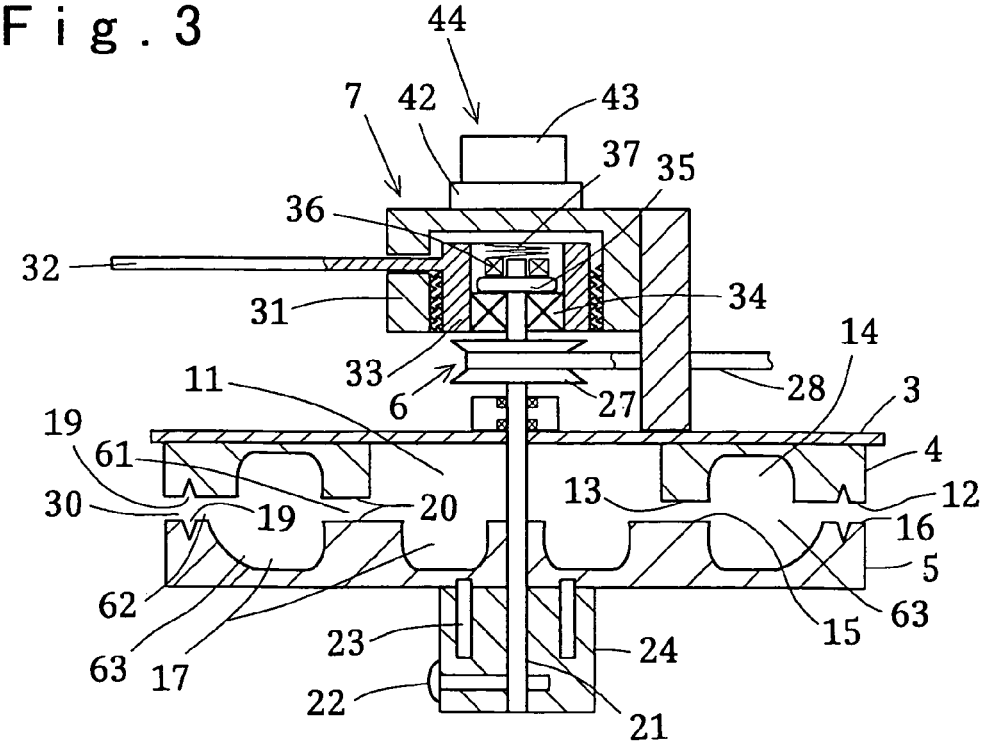
FIG. 3 is a partial enlargement of a part of FIG. 2.
Figure 4A:
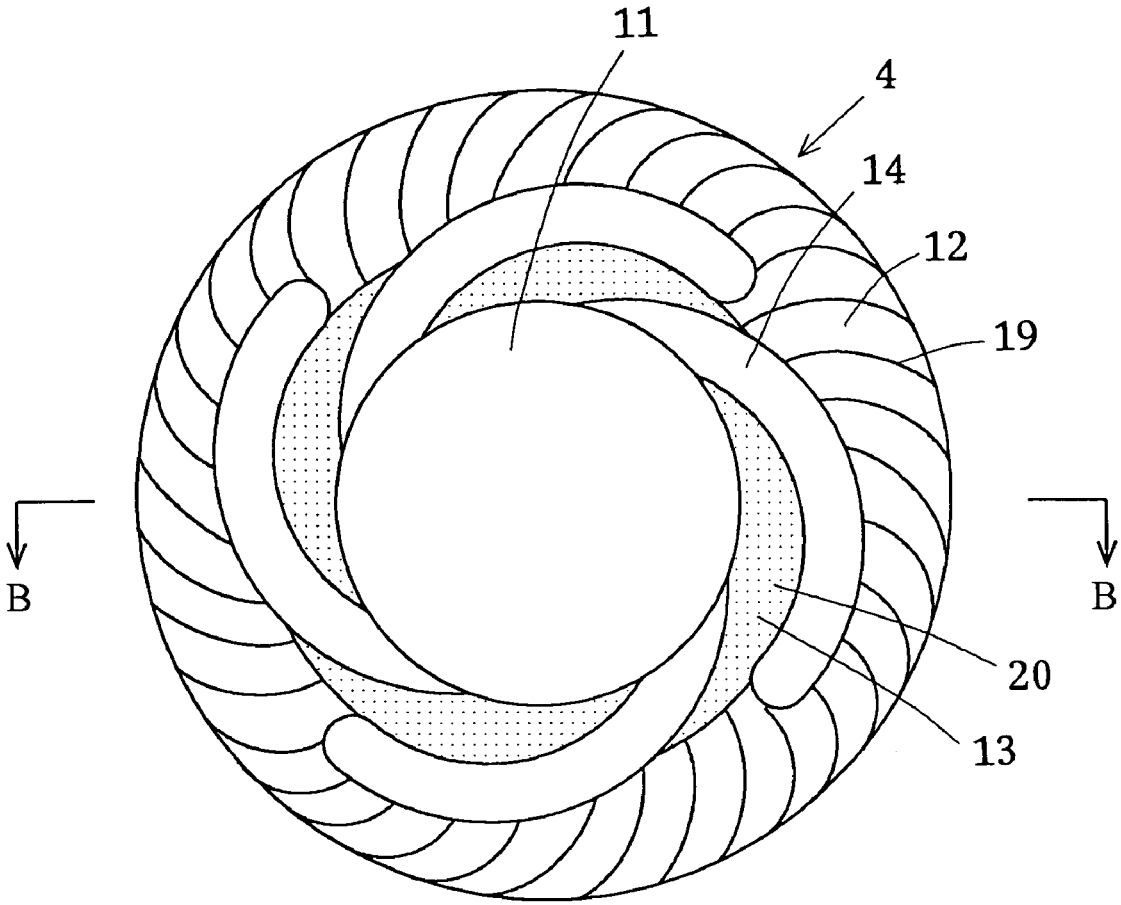
Figure 4B:
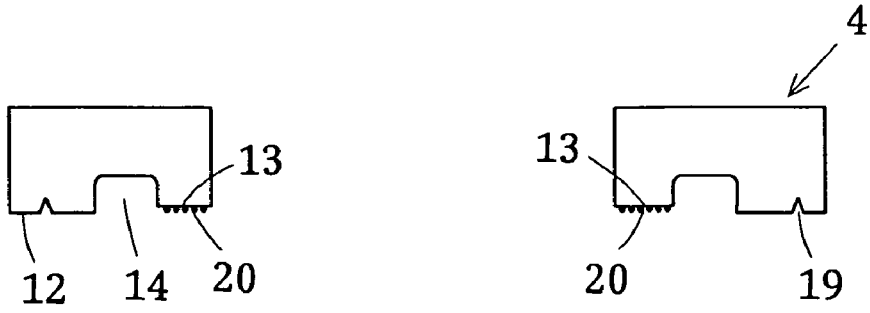

FIGS. 4(*a*) and 4(*b*) each show an underside view of the stationary crushing disc and a section thereof along the line B-B, respectively.

Figure 5A:
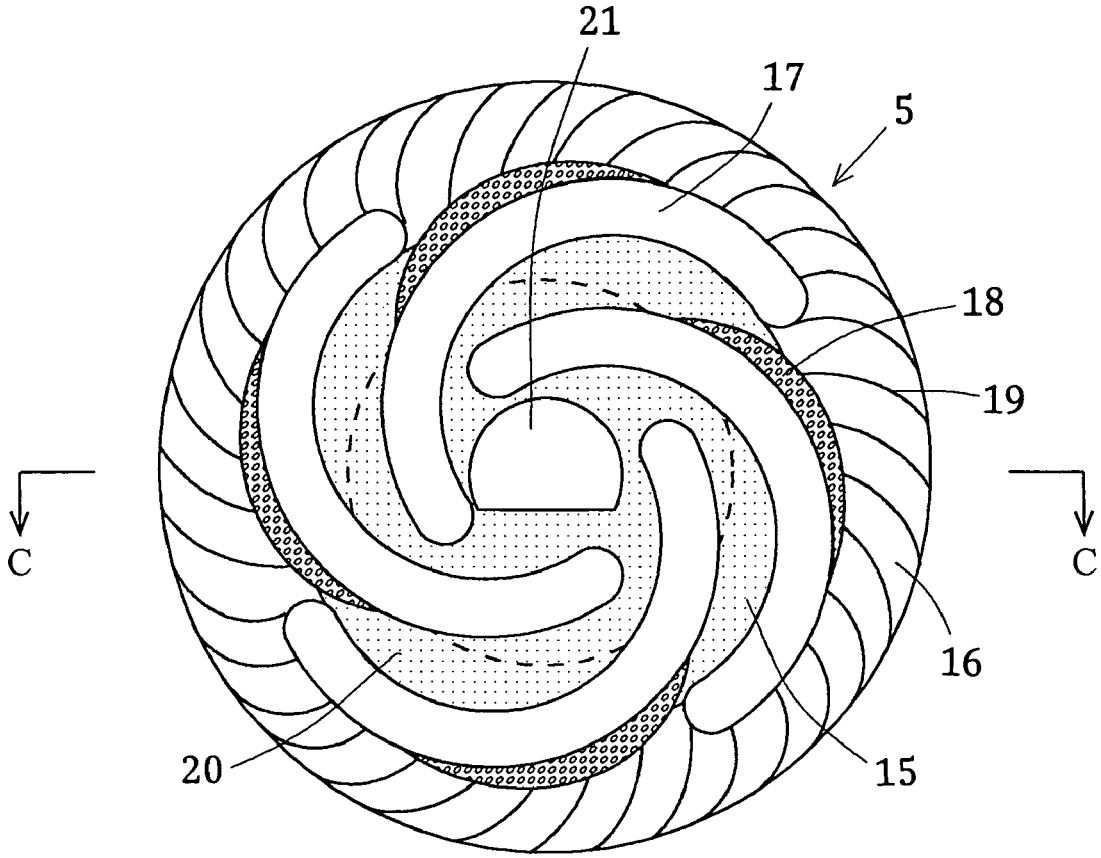
Figure 5B:
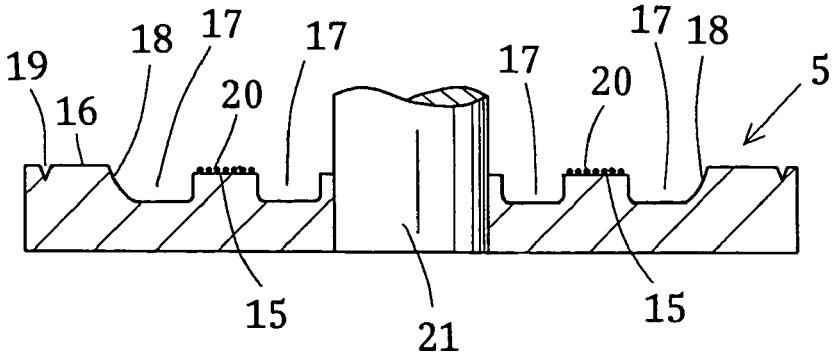

FIGS. 5(*a*) and 5(*b*) each show an upside view of the rotatable crushing disc and a section thereof along the line C-C, respectively.

Figure 6:
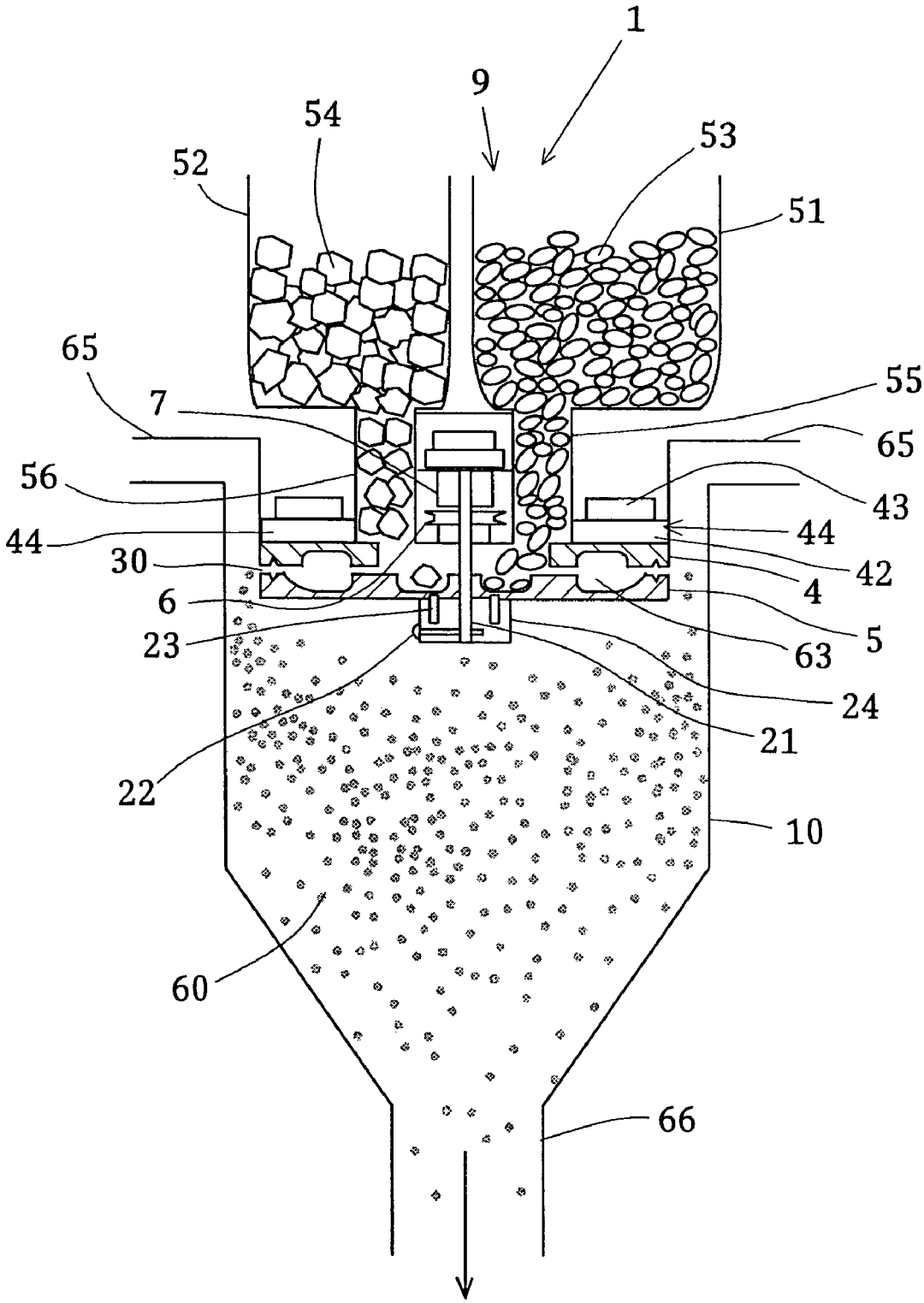

FIG. 6 is a vertical sectional view showing the apparatus for producing the crushed product as described in Example 2.

EXPLANATION OF THE SYMBOLS

The symbols indicate:

1: Production apparatus
2: Crusher body
3: Support element
4: Stationary crushing disc
5: Rotatable crushing disc
6: Power transmission means
7: Mill gap adjusting means
8: Driving device
9: Raw material supply section
10: Crushed product receiver
11: Raw material entrance port
12, 16: Fine-crush face
13: Abrader face
14, 17: Rough-crush dispensing groove
15: Abrader face
18: Dispensing section
19: Fine-crush groove
20: Layer of abrader material
21: Driving shaft
22: Fixing screw
23: Disc driving pin
24: Hub
26, 27: Pulley
28: Power transmission element
29: Control unit
30: Crushing section
31: Encasing cap
32: Manipulation lever
33: Inner cylinder
34: Slide supporting element
35: Rotary diskette
36: Rotary holder
37: Expansion element
41: Heat conductive plate
42: Cooling element
43: Heat depriving fan
44: Cooling unit
51: Main raw material hopper
52: Subsidiary raw material hopper
53: Main raw material
54: Subsidiary raw material
55, 56: Raw material supply path
57, 58: Sensor
60: Crushed product
61: Breaking-down part
62: Fine-crushing part
63: Rough-crushing site
65: Air intake passage
66: Air exhaustion passage

THE BEST MODE FOR EMBODYING THE INVENTION

Below, the present invention is described by way of embodiment with reference to the appended drawings.

The apparatus 1 for producing crushed product given in FIGS. 1 to 5 comprises a stationary crushing disc 4 fixedly held on a crusher body 2 on its support element 3, a rotatable crushing disc 5 arranged beneath the stationary crushing disc 4 in opposition thereto, a power transmission means 6 for transmitting rotational power to the rotatable crushing disc 5, a mill gap adjusting means 7 for adjusting the mill gap between the stationary and the rotatable crushing discs, a driving device 8 from which rotational power is transmitted to the power transmission means 6, a raw material supply section 9 and a crushed product receiver 10.

The stationary crushing disc 4 is provided in the central portion with a raw material entrance port 11 and, in the outer region on the underside with a fine-crush face 12. The rotatable crushing disc 5 is provided on its upper side with an abrader face 15 in the inner region, with a fine-crush face 16 in the outer circumferential region and with a plurality of rough-crush dispensing grooves 17 extending from the central portion to the fine-crush face in a bent form towards the rotation tail. Also, the stationary crushing disc 4 is provided at the inner side to the fine-crush face 12 with an abrader face 13 and a plurality of rough-crush dispensing grooves 14. On the fine-crush faces 12, 16, there are formed a number of fine-crush grooves 19 and the abrader face 15 is furnished with an abrader material layer 20. The fine-crush grooves 19 are formed on the fine-crush face side-by-side in a large number and at a high density, though it is shown in the drawings in a simplified depiction for the sake of easy understanding. The rough-crush dispensing grooves 17 of the rotatable crushing disc 5 are provided on the side of rotation head each with a dispensing section 18 which becomes shallower towards the outside periphery of the groove. In between the stationary crushing disc 4 and the rotatable crushing disc 5, there is arranged a crushing section 30.

In the central portion of the rotatable crushing disc 5, a driving shaft 21 is fixedly supported by a hub 24 provided with disc driving pins 23, using a fixing screw 22. The upper part of the driving shaft 21 extends through the raw material entrance port 11 of the stationary crushing disc 4 up above the stationary crushing disc 4 and is connected via the power transmission means 6 to the mill gap adjusting means 7. The rotatable crushing disc 5 is held suspended by the driving shaft 21. The power transmission means 6 is composed of a pair of pulleys 26, 27 and a power transmission element 28, here, a belt, spans over the pulleys 26, 27 and functions to transmit rotational power from the driving device 8, an electric motor, to the driving shaft 21 while preventing heat transfer. The numeral 29 indicates a control unit for controlling the rotation speed of the motor 8 as the driving device.

The mill gap adjusting means 7 is constructed in such a manner that an encasing cap 31 held on the support element 3 on the crusher body 2 encases an inner cylinder 33 provided with a manipulation lever 32 and allowing a screwing sliding therein, in which a rotary diskette 35 mounted on the driving shaft 21 sits on a slide supporting element 34 in the inner cylinder 33 while being pressed onto a rotary holder 36 by means of an expansion element 37 so as to permit sliding rotation thereon. The apparatus is constructed with a mechanism in which the rotatable crushing disc 5 held suspended by the driving shaft 21 is pressed onto the rotary holder 36 in the mill gap adjusting means 7 by the expansion element 37 and is rotated against the stationary crushing disc 4 in a plane parallel to the stationary crushing disc 4, even if the mill gap between the stationary disc 4 and the rotatable crushing disc 5 is varied by manipulation of the manipulation lever 32.

The stationary crushing disc 4 is provided, as a cooling means for cooling the mill, with a cooling unit 44 in which a cooling element 42 is attached to the stationary crushing disc 4 under intermediation with a heat conductive plate 41 and a heat-depriving fan 43 is arranged for depriving the generated heat. As the cooling means for cooling the rotatable crushing disc 5, a cooling unit 44 of similar construction as above is attached to the mill gap adjusting means 7, in which the rotatable crushing disc 5 is cooled through the driving shaft 21. As an additional cooling means, a heat-depriving fan 43 is arranged for cooling the entire arrangement by air ventilation.

In the raw material supply section 9, raw material supply paths 55 and 56, guided from a main raw material hopper 51 and from a subsidiary raw material hopper 52, a main raw material 53 and a subsidiary raw material 54 to the apparatus, respectively, and communicate to the raw material entrance port 11 of the stationary crushing disc 4. In each of the raw material supply paths 55, 56, there is arranged a sensor 57, 58 for detecting the absence or presence of the main or subsidiary raw material by means of a change in electrostatic capacity, from which corresponding signals are sent to the control unit 29 so as to prevent the unloaded operation of the apparatus. The crushed product receiver 10 is formed in a form of a vessel for collecting therein the crushed product 60 expelled out of the mill gap between the stationary crushing disc 4 and the rotatable crushing disc 5 at the disc periphery. Above, both sides of the vessel-form receiver 10, there are arranged an air intake passage 65 and an air exhaustion passage 66 for ventilation of air by the heat depriving fan 43.

The stationary crushing disc 4 and the rotatable crushing disc 5 are made of steel or another metal in the form of a circular disc. The stationary crushing disc 4 and the rotatable crushing disc 5 are coupled in opposition to each other so as to form between the underside of the stationary crushing disc 4 and the upside of the rotatable crushing disc 5 a crushing section 30. The crushing section 30 is composed of a breaking-down part 61 confined between the underside of the stationary crushing disc 4 and the abrader face 15 of the rotatable crushing disc 5 and a fine-crushing part 62 confined between the underside of the stationary crushing disc 4 and the fine-crush face 16 of the rotatable crushing disc 5. The rough-crush dispensing grooves 17 constitute a rough-crushing site 63 for effecting rough crushing of the raw material while it travels therein.

For producing the crushed product, raw materials are supplied to the apparatus 1 as described above to crush them therein. Thus, the main raw material 53 and the subsidiary raw material 54 are supplied to the raw material entrance port 11 from a main raw material hopper 51 and from a subsidiary raw material hopper 52, respectively, via each of the raw material supply paths 55, 56, whereupon the mill gap between the stationary crushing disc 4 and the rotatable crushing disc 5 is adjusted by manipulating the manipulation lever 32 of the mill gap adjusting mechanism 7 and, then, the rotatable crushing disc 5 is caused to rotate by transmitting rotational power from the driving device 8 via the power transmission means 6 to the driving shaft 21 while preventing heat transfer, cooling the stationary crushing disc 4 by the cooling element 42 and cooling the rotatable crushing disc 5 by the cooling unit 44 through the driving shaft 21. Thereby, the raw materials guided from the raw material entrance port 11 are caused to travel through the rough-crush dispensing grooves 14 and are subjected to rough crushing while they travel therethrough and, at the same time, hardly crushable raw material grains are broken down in between the underside of the stationary crushing disc 4 and the abrader face 15 of the rotatable crushing disc 5, whereupon the resulting roughly crushed mass is dispensed into the space between the fine-crushing faces 12 and 16 from the rough-crush dispensing grooves 14 to subject it to fine crushing. The finely crushed resulting crushed product 60 is expelled out of the mill gap between the stationary crushing disc 4 and the rotatable crushing disc 5 at the disc periphery, which is collected into the crushed product receiver 10 to thereby obtain the crushed product 60.

In the crushing section 30, the raw materials are caused to travel in the rough-crush dispensing grooves 14 by rotating the rotatable crushing disc 5 and subjected to rough crushing while they are traveling therethrough. In the breaking-down part 61, granular raw materials are subjected to abrasion of the grain surface by the abrader faces 13, 15 so as to break or to crack to break down hardly crushable thin films, such as flexible thin husk formed on the grain surface, and effect at the same time rough crushing of a part of the raw materials or the broken down mass thereof. The roughly crushed mass is then dispensed from the rough-crush dispensing grooves 14 to the fine-crushing part 62. Since the rough-crush dispensing grooves 14, 17 are arranged extending from the central portion to the fine-crush face 12, 16 in a bent form eddying out towards the rotation tail, each of the rough-crush dispensing grooves 14, 17 assumes at its terminal end a circular arcuate form nearly concentric with the circumferential circle of the crushing disc 4, 5 so that the rough-crush dispensing grooves 14, 17 each communicate at such a circularly arcuate end portion with the fine-crushing part 62, whereby a uniform dispensing of the roughly crushed material to the fine-crushing part 62 will be realized. When each of the rough-crush dispensing grooves 17 are not permitted to be formed in a circular form nearly concentric with the circumferential circle of the crushing disc, it may be preferable to provide each groove with a dispensing section 18 on the side of the rotation head, the section becoming shallower towards the outside periphery of the groove 17 so as to cause it to communicate with the fine-crushing part 62 via an arcuate form site of nearly a circle concentric with the circumferential circle of the crushing disc, whereby the roughly crushed material will be dispensed to the fine-crushing part 62 uniformly.

In the fine-crushing part 62 formed in the outer circumferential region of each crushing disc 4, 5, the broken-down material formed in the breaking-down part 61 and the roughly crushed material formed in the rough-crush dispensing grooves 14, 17 are subjected, in between the fine-crush faces 12 and 16, to shearing and breaking actions and are crushed there, whereby a crushed product 60 of fine particle size is obtained. During this, the hardly crushable thin skin layer, such as husk, that has been subjected in the breaking-down part 61 to destruction or cracking and broken down, is also sheared and crushed between the fine-crush faces 12 and 16 into small size particles, whereby a crushed product 60 of a wholly uniform fine particle size is obtained.

The mill gap between the stationary crushing disc 4 and the rotatable crushing disc 5 can be adjusted by manipulating the mill gap adjusting means 7, whereby the particle size of the crushed product 60 can be adjusted. The rotatable crushing disc 5 is suspended by the driving shaft 21 from the mill gap adjusting means 7 and can be rotated by the driving shaft 21 while preventing heat transfer from the driving device 8 by transmitting a rotational power thereto by means of a power transmission means 6 having a heat insulating power transmission element 28, such as a belt or the like. Heat generation is only limited to frictional heat due to rotation of the rotatable crushing disc 5. Therefore, the entire apparatus can be cooled by cooling the stationary crushing disc 4 and/or the rotatable crushing disc 5 through a cooling means, to thereby attain cooling of the raw material and of the crushed product, whereby the deterioration of the quality of the crushed product can be prevented. In a conventional crushing apparatus, denaturation of component substances may occur due to superfluous heating or oxidation when the rotatable crushing disc 5 is rotated at a high speed, whereby a crushed product of food may suffer from a debasement in quality, such as taste and mouth feel, in contrast to the crushed product of the present invention in which any denaturation or quality debasement is prevented due to the attainment of preventing heat generation, as described above.

In operating a rotary crushing mill at a high rotation rate, there may occur occasionally the trouble of machine blockage due to impasting of the crushed product 60 within the mill gap between the crushing discs 4 and 5. This trouble can be avoided in the apparatus of the present invention, since the rough-crush dispensing grooves 14, 17 are arranged extending from the central portion to the fine-crush face 12, 16 in a bent form eddying out towards the rotation tail to communicate with the fine-crushing part 62 at its terminal end in a circular arcuate form of nearly a circle concentric with the circumferential circle of the crushing disc 4, 5, whereby the roughly crushed material is dispensed from such a circularly arcuate end portion to the fine-crushing part 62 uniformly to thereby attain the prevention of impasting and blockage. When each of the rough-crush dispensing grooves 17 are not permitted to be formed in a circular form nearly concentric with the circumferential circle of the dispensing grooves 17, it is preferable to provide each groove with a dispensing section 18 on the side of the rotation head of the dispensing grooves 17, the section becoming shallower towards the outside periphery of the groove so as to cause it to communicate with the fine-crushing part 62 via a site of arcuate form of nearly a circle concentric with the circumferential circle of the crushing disc 17, whereby the roughly crushed material will be dispensed to the fine-crushing part 62 uniformly to thereby attain the prevention of impasting and blockage. If the distance of travel of the roughly crushed mass across the fine-crushing part 62 is longer, impasting of the crushed product may be apt to occur. Such an impasting trouble may be avoided by designing the grooves to have the pertinent length with uniform distribution over the entire area of the fine-crushing part 62. By establishing communication with the fine-crushing part 62 at the site of an arcuate form of nearly a circle concentric with the circumferential circle of the disc, the roughly crushed mass is dispensed to the fine-crushing part 62 towards the radial direction uniformly and will pass through the fine-crushing part 62 in a shorter and uniform distance, whereby impasting troubles can be avoided.

The crushed product 60 is expelled out of the mill gap between the stationary disc 4 and the rotatable crushing disc 5 at the disc periphery and collected into a crushed product receiver 10. By arranging a heat depriving fan 43 to aspirate atmospheric air via an air intake passage 65 and exhaust the apparatus inside air via an air exhaustion passage 66, the entire apparatus can be cooled by air ventilation. If a plurality of raw material supply paths 55, 56 are installed, a plurality of raw materials can be supplied via different raw material supply paths to effect co-crushing of them. When one raw material, for example, the subsidiary raw material 54 is a coolant such as dry ice, it is possible to perform the crushing while cooling the main raw material 53 by co-crushing with the coolant, whereby a crushed product 60 of superior quality can be obtained while preventing heat accumulation, denaturation and oxidation of the crushed product 60.

FIG. 6 shows a vertical section of the apparatus employed in Example 2 of the present invention, in which the crushed product receiver 10 has a form of a closed hopper and the apparatus is constructed so as to permit cooling of the entire apparatus by air ventilation by aspirating atmospheric air via the air intake passage 65 and exhausting the apparatus inside air via the air exhaustion passage 66. Other construction and component elements are the same as those in Example 1.

As described above, it is possible by the apparatus and process for producing crushed product described above to produce fine powdery crushed product by a simple arrangement and operation at a high efficiency, even for a raw material having a hardly crushable flexible thin skin layer, such as a cereal crop, by breaking down the hardly crushable thin skin layer efficiently into fine powder, whereby a crushed product with a uniform particle size can be obtained and, at the same time, a non-denaturable crushed product 60 of a high quality can be produced while preventing superfluous heating.

The crushed product 60 produced above exhibits a wholly uniform particle size of non-denaturable superior quality, even produced from a raw material having a hardly crushable flexible thin skin film, such as a cereal crop.

The processed goods according to the present invention exhibit a superior quality, since they are made from a raw substance comprising the crushed product according to the present invention constituted of a non-denaturable high quality fine powder of a wholly uniform particle size.

INDUSTRIAL APPLICABILITY

The present invention can be applied to a process and an apparatus for producing a crushed product by crushing raw materials of, for example, a food raw material, such as wheat, rice, buckwheat, soybean or the like, and other raw materials; to a crushed product; and to processed goods.

The invention claimed is:

1. An apparatus for producing a crushed product comprising a stationary crushing disc provided in its central portion with a raw material entrance port and in its outer region on its underside with a crush face, a rotatable crushing disc disposed beneath the stationary crushing disc in opposition thereto so as to form a mill gap therebetween and provided, on its upper side, in its inner region with an abrader face, in its outer circumferential region with a fine-crush face and in its inner region with a plurality of rough-crush dispensing grooves extending from a central portion thereof to the fine-crush face, a driving shaft which is fixedly connected to the central portion of the rotatable crushing disc and extends through and above the stationary crushing disc, a power transmission means for transmitting a rotational power from a driving device to the driving shaft while preventing heat transfer, a mill gap adjusting means which supports the rotational crushing disc through the driving shaft and is operable to adjust the mill gap between the stationary and the rotatable crushing discs, a cooling means for cooling the stationary crushing disc and/or the rotatable crushing disc, a raw material supply path for supplying raw material to the raw material entrance port in the stationary crushing disc and a crushed product receiver for receiving the crushed product expelled out of the mill gap at the disc periphery.

2. The apparatus as claimed in claim 1, wherein the stationary crushing disc is provided, in the inner region on the underside thereof, with an abrader face and/or a plurality of rough-crush dispensing grooves.

3. The apparatus as claimed in claim 1, wherein the rotatable crushing disc is provided on the abrader face with a layer of an abrader material.

4. The apparatus as claimed in claim 1, wherein the rotatable crushing disc is provided on its fine-crush face with a plurality of thin grooves extending from its central portion to its outer circumferential region.

5. The apparatus as claimed in claim 1, wherein the rough-crush dispensing groove is provided with a dispensing section that becomes shallower towards the outside periphery of the groove.

6. The apparatus as claimed in claim 1, wherein a plurality of raw material supply paths are arranged for supplying a plurality of raw materials to the raw material entrance port.

7. A process for producing a crushed product, comprising supplying a raw material to be crushed via one or more raw material supply paths to a mill gap formed between a stationary crushing disc and a rotatable crushing disc, said stationary crushing disc being provided in its central portion with a raw material entrance port and in its outer region on its underside with a crush face, and said rotatable crushing disc being disposed beneath the stationary crushing disc in opposition thereto and provided on its upper side, in its inner region, with an abrader face, in its outer circumferential region, with a fine-crush face and, in its inner region, with a plurality of rough-crush dispensing grooves extending from the central portion to the fine-crush face, adjusting the mill gap between the stationary crushing disc and the rotatable crushing disc by means of a mill gap adjusting means which supports the rotatable crushing disc through a driving shaft, rotating the rotatable crushing disc by transmitting a rotational power from a driving device to the driving shaft while preventing heat transfer and cooling the stationary crushing disc and/or the rotatable crushing disc, effecting a rough crushing of the raw material while the raw material is caused to travel through the rough-crush dispensing grooves from the raw material entrance port and, at the same time, breaking down a hardly crushable raw material between the underside of the stationary disc and the abrader face of the rotatable crushing disc and dispensing the resulting roughly crushed mass to the mill gap between the crush faces from the rough-crush dispensing grooves to subject it to fine crushing and collecting the resulting crushed product expelled out of the mill gap between the stationary and the rotatable crushing discs at the disc periphery.

8. The process as claimed in claim 7, wherein a plurality of raw materials are supplied from a plurality of raw material supply paths to the raw material entrance port to effect co-crushing.

9. The process as claimed in claim 8, wherein one of the raw materials is a coolant so that the co-crushing is effected under cooling.

10. The process as claimed in claim 7, wherein the crushed product is produced using an apparatus comprising the stationary crushing disc, the rotatable crushing disc, the driving shaft which is fixedly connected to the central portion of the rotatable crushing disc and extends through and above the stationary crushing disc, a power transmission means for transmitting a rotational power from the driving device to the driving shaft while preventing heat transfer, the mill gap adjusting means, a cooling means for cooling the stationary crushing disc and/or the rotatable crushing disc, a raw material supply path for supplying the raw material to the raw material entrance port in the stationary crushing disc and a crushed product receiver for receiving the crushed product expelled out of the mill gap at the disc periphery.

* * * * *